US007941981B2

(12) United States Patent
Shaw

(10) Patent No.: US 7,941,981 B2
(45) Date of Patent: May 17, 2011

(54) FIRE BARRIER SYSTEM INCLUDING PREASSEMBLED, ONE-PIECE, MULTI-DIRECTIONAL FIRE BARRIERS READY FOR INSIDE-MOUNTING IN MULTI-DIRECTIONAL ARCHITECTURAL EXPANSION JOINTS, CUSTOM BARRIER SPECIFIC INSTALLATION TOOLS, AND COVER PLATE AND/OR SPREADER DEVICES

(75) Inventor: Alan Shaw, Lockport, NY (US)

(73) Assignee: Fireline 520, LLC, Buffalo, NY (US)

( * ) Notice: Subject to any disclaimer, the term of this patent is extended or adjusted under 35 U.S.C. 154(b) by 910 days.

(21) Appl. No.: 11/709,947

(22) Filed: Feb. 23, 2007

(65) Prior Publication Data

US 2008/0022613 A1 Jan. 31, 2008

Related U.S. Application Data

(63) Continuation-in-part of application No. 11/295,910, filed on Dec. 7, 2005.

(60) Provisional application No. 60/775,950, filed on Feb. 23, 2006.

(51) Int. Cl.
*E04C 2/00* (2006.01)

(52) U.S. Cl. ..... 52/232; 52/396.01; 52/393

(58) Field of Classification Search ..... 52/396.01, 52/393, 396.1, 402, 463, 459, 232
See application file for complete search history.

(56) References Cited

U.S. PATENT DOCUMENTS

| | | | | |
|---|---|---|---|---|
| 5,974,750 | A | | 11/1999 | Landin et al. |
| 6,012,869 | A | * | 1/2000 | Braun ..... 404/64 |
| 6,128,874 | A | * | 10/2000 | Olson et al. ..... 52/232 |
| 6,131,352 | A | * | 10/2000 | Barnes et al. ..... 52/396.01 |
| 6,192,641 | B1 | | 2/2001 | Andraso et al. |

* cited by examiner

*Primary Examiner* — Basil Katcheves
(74) *Attorney, Agent, or Firm* — Patricia M. Costanzo, Esq.

(57) ABSTRACT

Multi-directional, one-piece, tested and rated, inside-mount fire barriers requiring no splicing to fit into expansion joint corner-type spaces are presented. Accompanying low-cost, re-useable, size-adjustable installation tools designed for one-step, drop-in, installation of each style barrier, are also taught. To insure a tight-fit between each installed barrier and the building units forming the joint space, spreader press-fit tools which, if desired, may serve as fire barriers covers are taught. Described herein is a barrier that needs no splicing to be installed into a T-shaped joint space that is created by the convergence of three building structures. The present invention contemplates inside-mounted, one-piece barriers shaped to fit cross-shaped and various L-shaped expansion spaces. L-shaped fire barriers include barriers having a horizontal and a vertical arm that can occur in various configurations and barriers having two horizontal arms.

7 Claims, 7 Drawing Sheets

FIRE BARRIER SYSTEM INCLUDING PREASSEMBLED, ONE-PIECE, MULTI-DIRECTIONAL FIRE BARRIERS READY FOR INSIDE-MOUNTING IN MULTI-DIRECTIONAL ARCHITECTURAL EXPANSION JOINTS, CUSTOM BARRIER SPECIFIC INSTALLATION TOOLS, AND COVER PLATE AND/OR SPREADER DEVICES

CROSS-REFERENCE TO RELATED APPLICATIONS

This Continuation-in-Part application claims the benefit of U.S. Continuation-in-Part patent application Ser. No. 11/295,910 filed Dec. 7, 2005 and U.S. Provisional Application Ser. No. 60/775,950 filed Feb. 23, 2006.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF THE INVENTION

The present invention relates generally to fire barriers and more particularly to fire and cycle tested, inside-mounted, one-step, drop-in installation, one-piece continuous construction, multi-directional fire barriers for multi-directional architectural expansion joints, and tools for installing said fire barriers.

The background information discussed below is presented to better illustrate the novelty and usefulness of the present invention. This background information is not admitted prior art. The particular versions of the invention as described below are provided, in part, as illustrative and exemplary. Thus, the described versions should not be taken as limiting. Additionally, the invention is not limited to the examples provided.

Modern building codes require building design to take into account the stresses that buildings often experience, such as extreme or repetitive changes in temperature, the force of wind impinging on the building, forces due to seismic events, settling of subsoil, remodeling of the building, excavation on or near the site, and other forces. To accommodate these stresses, buildings must now be constructed with code mandated spaces between wall, floor, and ceiling structures. These spaces, referred to as "expansion joints," allow differential building movement to take place without risking damage to the whole structure.

While expansion joints do serve the function for which they are employed, that is to improve the integrity of the structure when the building units are subjected to contraction or expansion, expansion joints also present a major risk to the structure. During a fire the expansion joint spaces act as chimney flues providing pathways for gases, flame, and smoke to spread rapidly throughout the structure creating what is known as the "chimney effect." To counter this effect, building codes for public and commercial structures generally require fire barriers to be installed in the expansion joint spaces to prevent flames and smoke from passing through the joint spaces. Although various fire barriers are presently available, there are no tested, ready to be installed, fire barriers ready for use in multi-directional expansion joint spaces.

Logically, fire barriers should be classified into two major structural categories: straight-line barriers and multi-directional barriers. Presently available barriers are referred to as "straight line barriers." These barriers are designed to fit into straight-line expansion joint spaces, such as the joint space that occurs between two adjacent building wall units. An expansion joint space, however, often intersects one or more other expansion joint spaces. These intersection joint spaces are found at the juncture of a plurality of building structures, such as when four walls meet to create a cross-wise gap, or where two exterior walls and an interior wall meet creating a "T"-shaped gap. Such multi-directional expansion joints require multi-directional fire barriers as it is structurally impossible for straight line barriers to accommodate the multi-directionality of multi-dimensional intersection joint spaces. Presently, the fire barrier industry is able to provide only jerry-rigged, untested, fire barriers for multi-directional expansion joints. These jerry-rigged barriers are constructed, on-site, from spliced together parts of straight line barriers. It is well-accepted, however, that spliced joints are weak joints. The seams created by splicing are not air-tight and, thus, would allow hot air, smoke, toxic gases, and the like to travel throughout the interior joints of a building greatly reducing any effective time fire-fighters have to get to the fire or for people to leave the burning structure in safety. In addition to being pre-assembled to fit the various multi-dimensional expansion joints, fire barriers should be capable of accommodating the complex differential movement building structural units undergo and be able to retain their resiliency over an extended period of time under dynamic conditions. On-site spliced fire barriers cannot be fire or cycle tested. Additionally, site assembly is time consuming and requires more than one installation person increasing the total construction cost. Because of the inherent weakness of spliced barriers, they are unlikely to hold under even mild stress conditions. During a fire event, building joints are likely to be subject to even greater stress than usual, thereby making it essential that the fire barriers retain their integrity to prevent the migration of gases, flame, and smoke.

In many instances, fire barriers are draped into a joint space with planned for excess side material overlapping the edges of a building unit, such as the top ends of a wall unit. Attachment means, such a screws or bolts are inserted into the top ends of the wall units through the overlap fire barrier material to provide a means of securing the fire barrier to the wall. There are situations, however, where the building specifications do not permit attachment means extruding from the top ends of wall units, for example. In this case, the fire barriers should be "inside-mounted," that is, the opposing sides of a barrier that is forming a "U" between two wall units will serve as the material through which mounting means will be secured into the building units during the installation process.

Presently available tested fire barriers and the on-site spliced barriers are often the cause of installer injury. Fire barriers usually comprise at least a sheet of stainless steel foil. As each fire barrier has to be handled by the installers the arms and hands of the installers often suffer injury from the sharp protruding edges of the stainless steel foil. Moreover, whenever a fire barrier made with some type of fiber glass material or the like is jerry-rigged on-site, the cutting process emits fibers, some of which are small enough to be breathable creating a breathing air hazard. What is needed are not only pre-assembled fire barriers, but an installation tool that reduces or eliminates direct handling of the barriers. More over, to save cost the installation tool should be low cost, size-adjustable and reusable.

One way to insure that installed fire barriers prevent the passage of smoke, gas, heat, or flame from traveling through the barrier from one floor to another, for example is to ensure that the sides of the barrier (the sides forming the "U" of the installed barrier) are secured tightly to the sides of the building units leaving no gaps between the barrier and the building unit. It would be a great asset to have a means for press-fitting the barrier to the building units as they are readied for the barrier to building unit attachment means to secure the barrier to the building units.

It is clear then that a fire and cycle tested, pre-assembled, straight-line and multi-directional fire barriers constructed as single-piece, continuous units requiring no on-site splicing and providing for one-step, drop-in inside-mount installation by one person into multi-directional joints to prevent the migration of gases, flame, and smoke as well as providing for inside-mounting are urgently needed. Also clearly needed are re-useable, size-adjustable installation tools that provide for one person, one-step, drop-in installation of pre-assembled, continuous, multi-directional/multi-dimensional fire barriers that require no splicing.

SUMMARY

Accordingly, the invention described herein addresses these several interdependent heretofore unmet needs. The present invention solves the problem of reducing or preventing the "chimney effect" cause of rapid spread of flames, heat, and smoke throughout a structure by teaching fire and cycle, code tested, straight-line, multi-directional/multi-dimensional structural fire barriers for installation into the spaces created by the intersection of architectural expansion joints, where the barriers are constructed as stand-alone units requiring no splicing to fit into intersection or corner-type joint spaces. Accompanying low-cost, re-useable, size-adjustable, installation tools designed expressly for one-step, drop-in, inside-mount installation are also taught. And to insure a tight-fit between each installed fire barrier and the building units forming the expansion joint space spreader press-fit tools which may, if desired, serve as fire barriers covers, are also provided.

The fire and cycle tested fire barriers of the present invention are unique in several ways. One point of novelty is the variety of inside-mounted, fire and cycle tested, straight-line, multi-directional, and three-dimensional configurations that can be constructed as continuous one-piece devices using the fundamental layer regardless of the number or kinds of fire-resistant sheets that are used to construct a fundamental layer. A favored embodiment described herein is an inside-mounted, one-piece T-shaped fire barrier that needs no splicing to be installed into a T-shaped expansion joint space created by the convergence of three building structures, such as three walls. The T-shape, as illustrated, is only one of a large number of possible configurations that are embodied with the principles of the mount present invention. The present invention contemplates inside-mounted, one-piece fire barriers shaped to fit into cross-shaped, T-shaped, and L-shaped expansion joint spaces. L-shaped fire barriers include barriers having one horizontal and one vertical arm that can occur in various configurations to meet specific requirements, and barriers having two horizontal arms.

Yet another feature of the present invention is that regardless of the structure of multi-dimensional expansion joint system that the fire barrier is designed to fit, all of the barriers are constructed to be able to undergo movement including expansion and contraction to match the expansion and contraction suffered by the structural units to which the barriers are attached. To this end the barriers of the present invention are constructed to withstand the rigors of cycle testing. Additionally, each of the materials used in the construction of the fire barriers meets Underwriters Laboratory, Inc. required specifications for materials used in a fire barrier joint system. Moreover, to date, the horizontal/vertical L-shaped barrier and the straight line have passed both the fire and cycle UL tests.

Additionally, each style of fire barrier is accompanied by its own low-cost, size-adjustable, reusable installation tool that provides, in most cases, for one person, one-step, drop-in installation of the fire barriers made according to the principles of the present invention. The installation tool is not only reusable it is also easily and rapidly resized for use with different sized versions of the same style barrier.

All of these benefits and more are made available by providing for a fire barrier system, comprising:

unitary fire resistant barriers pre-assembled and shaped for drop-in no splicing installation of the barriers into multi-dimensional architectural expansion joint spaces formed by the intersection of two or more architectural expansion joint spaces, each of the joint spaces defined by a first and a second building unit, comprising:

at least one fire barrier structural unit branching seamlessly from at least one second fire barrier structural unit, each fire barrier structural unit comprising at least one flexible sheet of a fire barrier material, and each of the flexible sheets of a fire barrier material comprising a first portion attached to a first building unit attachment area by a first attachment means and a second portion attached to a second building unit attachment area by a second attachment means, and an intermediate portion having a width located generally in the joint space.

Additionally, the fire barrier system further comprises:

an installation tool for the installation of the fire resistant barriers, the tool comprising:

a) a frame functionally shaped and sized for:

i) fitting within the fire resistant barrier, ii) detachably attaching to the fire resistant barrier, and simultaneously iii) being supported by the building units;

b) attachment means fixedly attached to the frame for the detachable attachment of the installation tool to the fire resistant barrier providing for the drop-in installation of the fire resistant barriers and for the removal of the installation tool from the fire resistant barrier when the installation is complete. The installation tool further comprises grasping means attached to the frame for lifting the frame while attached or detached from the fire resistant barrier.

A favored embodiment is where the fire barrier system comprises wherein the fire resistant barrier is constructed as an L-shaped vertical/horizontal-shaped fire barrier. This embodiment was tested and rated in accordance with ASTM E1966-01 *Standard Test Method for Fire Resistive Joint Systems*, in addition to having successfully met the conditions of Type IV movement according to Cycle test ASTME 1399.

BRIEF DESCRIPTION OF THE DRAWINGS

In order that these and other objects, features, and advantages of the present invention may be more fully comprehended, the invention will now be described, by way of example, with reference to the accompanying drawings, wherein like reference characters indicate like parts throughout the several figures, and in which.

DEFINITIONS

Figure 1:
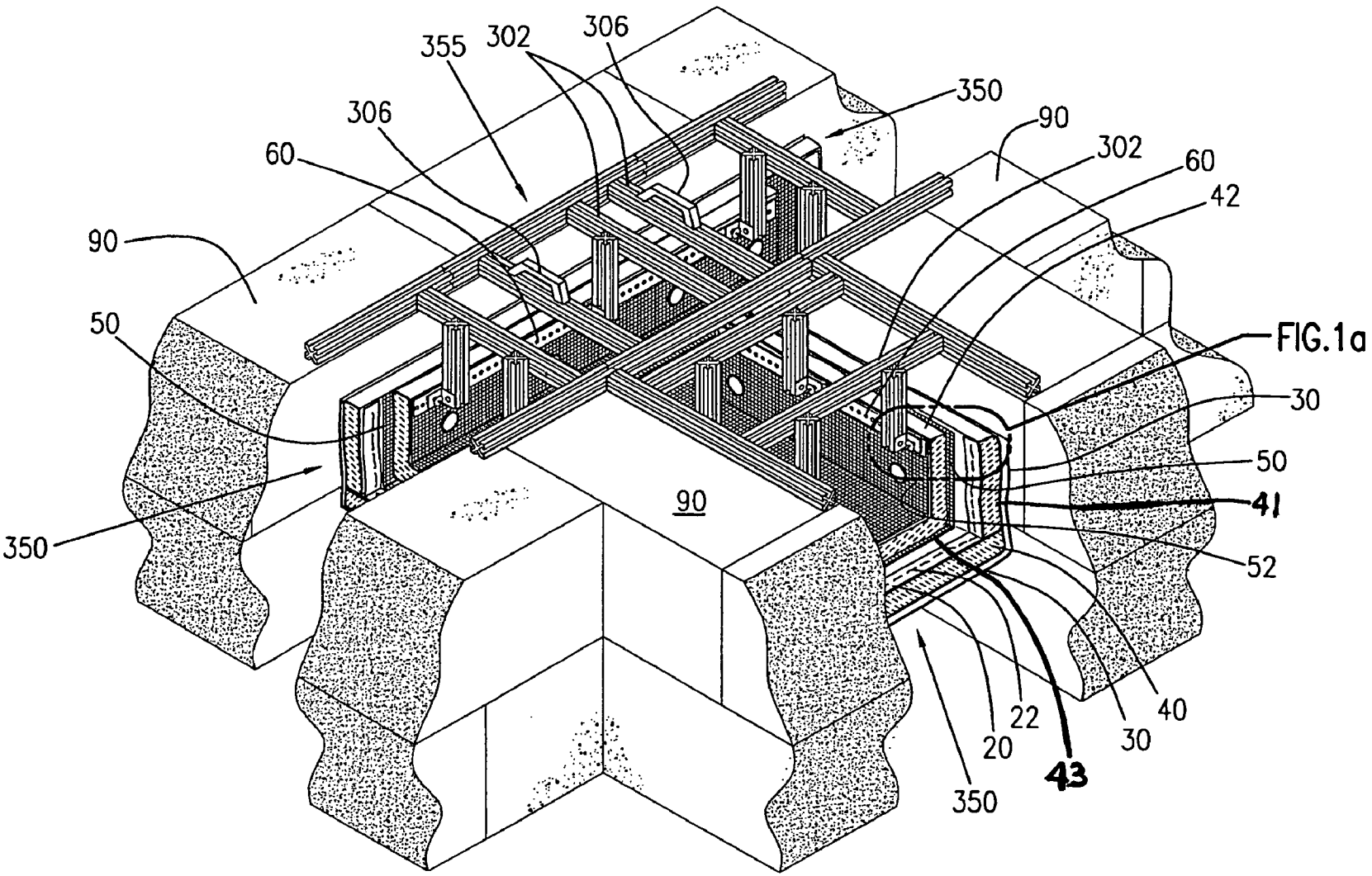
FIG. 1 is a perspective view illustrating a T-shaped fire barrier installation tool of the present invention attached to a T-shaped fire barrier of the present invention for the inside-mount installation of the barrier into a T-shaped building expansion joint.

Attachment means, as used herein, referring to attachment means used to attach the fire barriers as taught herein to the building units creating the expansion joint spaces includes bolts, screws, staples, and glue or other adhesive.

Branch, as used herein, refers to something, such as a structural unit, that extends from, enters into, or is an offshoot of a main body or structural unit, with no defining break or distinction of the material of the structural unit, as one river branching from another, a tree branch branching from another, or an arm or leg branching from the trunk of a body.

Building units, as used herein, refers to structures such as walls, floors, ceilings, and the like, and may be referred to as structural units.

Common material, as used herein, refers to material that is common to more than one unit or part of a unit, where such a part of a unit is referred to herein as a structural branch. Such a material, displaying the same properties, but found in a biological setting is a coenosarc, which is material linking polyps in a colony, such as is found in the colonial form of coral, the polyps (the colonial animals) each are a part or unit of their common coenosarc.

Intumescent as used herein, refers to those materials having properties that cause them to expand (or intumesce) to several times their original size when activated by high temperatures to prevent the spread of flames and smoke to other parts of a building, for example passive fire-seals contain intumescent compounds.

Insulation blanket, as used herein, refers to any number of insulation materials, including fiber blankets made from alumina, zirconia, and silica spun ceramic fibers, fiberglass, and the like.

High-temperature thread, as used herein, refers to any thread that is fire resistant or any thread that will not support combustion, such as a ceramic thread.

Metallic backing layer, as used herein, refers to fire resistant metal or metallicized foil, such as stainless steel, or the like.

Multi-directional and/or multi-dimensional architectural expansion join or joint, as used herein refers to any joint that is formed by the convergence of more than two structural units, such as the convergence of three wall units or two walls and a floor unit. These joints create spaces between building units that act like chimney flues carrying gases, hot air, flame, and smoke throughout a structure.

Multi-directional and/or multi-dimensional fire resistant barrier, as used herein, refers to any fire barrier that is shaped to functionally fit into a multi-directional and/or multi-dimensional architectural expansion joint.

Protective cloth, as used herein, refers to a flexible, strong, protective, fire-resistant material that is designed to mechanically support the insulation material and to protect the insulation material from mechanical damage, as the insulation is mechanically weak and can be easily damaged by tearing or ripping either accidentally or intentionally during or after installation thus largely compromising the integrity of the fire resistant barrier. The fire resistant layers, such as a layer of insulation material together with a layer of intumescent material, can freely move with respect to the one or more protective layers or they may be attached together via threads or other attaching means. Protective cloths may be manufactured from continuous filament amorphous silica yarns, polymeric material, fiber reinforced polymeric material, high-temperature resistant woven textiles, or a metalized, fiberglass cloth. Metalized cloth may include fibers of stainless steel, aluminum, or copper, for example. Protective materials may also include metal foils or metal screens.

Seaming, as used herein, refers to connecting one part to another part, for example where a cloth is folded and the two parts of the cloth that have been brought together by the folding are subsequently "seamed" together along a predetermined line. The seaming may utilize stitching, using an adhesive, stapling, pinning, or any other means that will connect the two parts to each other.

Spreader, also referred to as press plate, as used herein, refers to any implement or apparatus for applying a pushing force directly to a generally stationary object upon which pressure or tension is to be exerted. It comprises jacks (including lifting jacks, floor jacks, and analogous implements), extracting apparatus (including stump pullers and nail extractors), tensioning apparatus (including belt, carpet and wire stretchers), hoist trucks, and cable-type load hauling or hoisting apparatus, and pressure plates under spring tension including torsion springs.

Strapping, as used herein, refers to off-the-shelf fire-resistant strapping used in construction and fabrication for holding, binding, and/or attaching, such as commonly available steel strapping.

Structural unit, as used herein, refers to such constructs as a wall, floor, ceiling, or the like and may be referred to as building units.

Tributary, as used herein, refers to a construct which flows uninterruptedly into another construct (see Branch).

Tri-dimensional, as used herein, refers to either an expansion joint that has three member parts, such as a T-shaped expansion joint where the T-joint is made up of three co-joint-arms or to a fire barrier that is functionally shaped to accommodate a T-shaped joint.

Torsional, as used herein, refers to the force with which a wire returns to a state of rest after having been twisted round its axis, referred to as torsional force, whereas torque, by definition, is a force that produces rotation.

Torsion springs, as used herein, refer to springs that exert a force (torque) in a circular arc, and that have arms rotating about the central axis. Torsion springs, whose ends are rotated in angular deflection, offer resistance to externally applied torque. The wire itself is subjected to bending stresses rather than torsional stresses, as might be expected from the name. Springs of this type are usually close wound, reduced in coil diameter, and increase in body length as they are deflected. The designer must consider the effects of friction and arm deflection on the torque. Special types of torsion springs include double torsion springs and springs having a space between the coils to minimize friction. Double torsion springs consist of one right-hand and one left-hand coil section connected together, and working in parallel. The sections are designed separately with the total torque exerted being the sum of the two. It is customary to specify torque with deflection or with the arms at a definite position. Formulas for torque are in pound-inches or inches-pounds. If ounce-inches are specified the value should be divided by 16 to use the formulas in the inch-pound system. When a force is specified at a distance from a centerline, or the torque, the distance is called moment, which is equal to the force, multiplied by the distance. Force can be in pounds or ounces with the distance in inches or the force can be in meters with the distance in millimeters. Formulas for torques are based on the tangent to the arc of rotation with a rod to support the spring. The stress in bending caused by the moment is identical in magnitude to the torque, provided that a rod is used.

Tests

Fire Test ASTM E1966-01 *Standard Test Method for Fire Resistive Joint Systems* (UL 2079)

Cycle Test ASTM E 1399 *Standard Test Method for Cyclic Movement and Measuring the Minimum and Maximum Joint Widths of Architectural Joint Systems*

A LIST OF THE REFERENCE NUMBERS AND RELATED PARTS OF THE INVENTION

20 Intumescent strip material.

22 High-temperature thread.

30 Protective cloth.

40 First insulation blanket.

41 Metallic layer adhered to 40.

42 Second insulation blanket.

43 Metallic layer adhered to 42.

50 First fire-resistant supporting mesh.

52 Second fire-resistant supporting mesh.

60 Fire-resistant strapping.

70 Friction-fit washer to attach fire barrier to building unit 90.

70B Friction-fit washer to attach fire barrier sheets to each other to form a layer.

70T Friction-fit washers to attach installation tool to fire barrier.

72 Pin to attach fire barrier to building unit 90.

72B Pin to attach fire barrier sheets to each other to form a layer.

72T Pin to attach installation tool to related fire barrier.

74T Spacer.

76T Fasteners to attach installation tool to related fire barrier.

90 Building unit.

302 Width determining exchangeable installation tool segments.

306 Tool grasping means.

350 Three-way or T-shaped fire barrier for inside installation.

355 Installation tool for installing 350.

DETAILED DESCRIPTION

Referring now particularly to the drawings which show views of exemplary versions of the inside-mount barriers, and installation tools contemplated by this invention. The drawings also illustrate how the above described disadvantages have been overcome. It should be noted that the disclosed invention is disposed to versions in various sizes, widths, depths, shapes, contents, layers, materials, and forms. Therefore, the versions described herein are provided with the understanding that the present disclosure is intended as illustrative and is not intended to limit the invention to the versions described herein.

FIG. 1, a perspective view of two favored embodiments of the present invention, illustrates a T-shaped inside-mount fire barrier installation tool 355 securely attached to an inside-mount T-shaped fire barrier 350. T-shaped fire barrier 350 comprises outer protective cloth 30 overlain by first insulation blanket 40 with adhered metallic backing layer 41 and edged with intumescent strip material 20 that is stitched to first insulation blanket 40 by means of high-temperature thread 22, first fire-resistant supporting mesh 50, second insulation blanket 42 with adhered metallic backing layer 43, second fire-resistant supporting mesh 52, and fire-resistant strapping 60. T-shaped fire barrier installation tool 355 is securely, but detachably attached to fire barrier 350 via attachment means (described in detail below and illustrated in FIG. 1*a*) via fire-resistant strapping 60. Fire-resistant strapping material 60 as illustrated is a common and inexpensive metal strapping material, having apertures along its length. Installation tool handles 306 are positioned for easy and sure grasping of tool 355 by one person. Installation tool 355 provides for the secure, yet detachable, attachment of the tool to barrier 350 so that one person may attach the tool to the barrier, carry the barrier with minimal effort to the installation site, and position the T-shaped fire barrier within a T-shaped building expansion joint, as illustrated, for the secure attachment of the barrier to the building units.

T-shaped fire barrier installation tool 355, as illustrated in FIG. 1, is constructed using readily available 80/20 The Industrial Erector Set® modular framing strips, although it is to be understood that the invention does not depend on this particular material. In the illustrations provided, the framing that is used is the T-slotted framing provided by 80/20 Inc. although any other suitable strong, yet light-weight material, such as aluminum or wood strips would work just as well. It is to be understood that the invention does not depend on the exact material used to construct the installation tool. It is also contemplated that the installation tool is to be manufactured using a time and cost efficient, assembly line, molding-type of manufacturing. The use of the installation tool is not an absolute necessity for the installation of the fire barriers, although its use greatly reduces the time, effort, and cost required for installation. The use of the tool for installation also improves the safety of the installers and ensures the integrity of the barrier during the installation process. As illustrated, T-shaped fire barrier installation tool 355 is provided partially assembled, with tool grasping means 306 fixedly attached to the top side of the tool readily available for use. The top side of the tool is that side that is open to view between the building units after the barrier and the attached tool have been inserted into the expansion joint space defined by the building units. Because expansion joints occur over a range of sizes, from about four to twelve inches wide and because fire barriers must be provided over a range of widths, installation tools must also be available in a range of widths. The present invention accommodates this need and minimizes cost and materials needed for installation by providing installation tool width adjusting means. The width of the size-adjustable installation tool is rapidly and easily adjusted using segments 302, as illustrated in FIG. 1*b*, and a screwdriver. The last step in the construction of the installation tool as illustrated, although the order of the steps given here is for example only and could be rearranged while staying in the principles of the present invention, is the additional of the attachment means that will be used to attach the tool to the barrier. The attachment of this L-shaped bracket is not an inventive step as such attachment means are well-known in the art and comprise screws, bolts, soldering, and the like and need not be discussed further here. If the use of a single unit attachment tool is preferred, the tool is available completely formed through the molding-type manufacturing process with a built-in sliding means of width size adjustment.

Figure 1A:
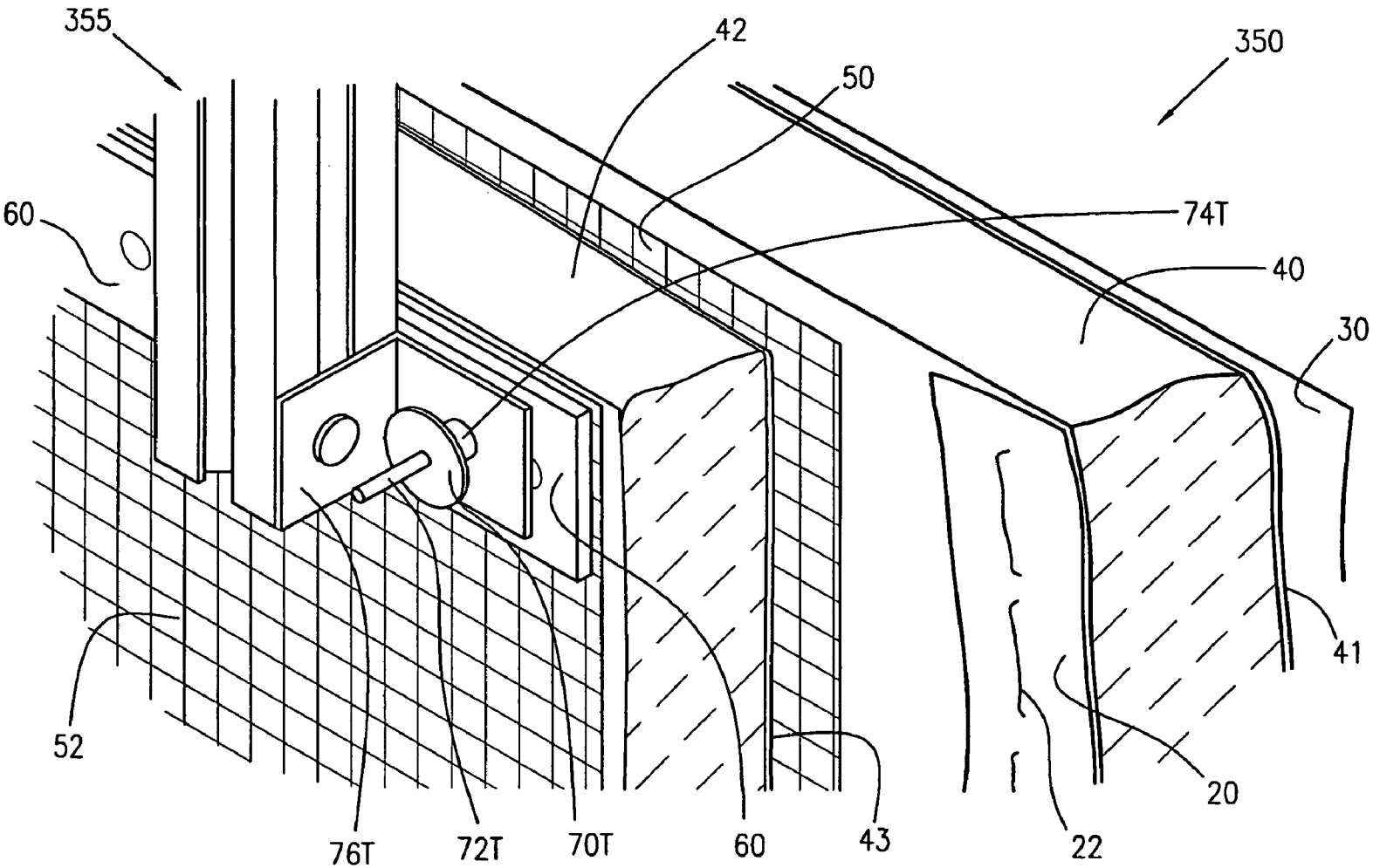
FIG. 1*a* is a perspective exploded view of area "FIG. 1*a*" as indicated in FIG. 1 to more clearly illustrate the temporary attachment means used for the temporary attachment of the installation tool to the barrier.
Figure 1B:
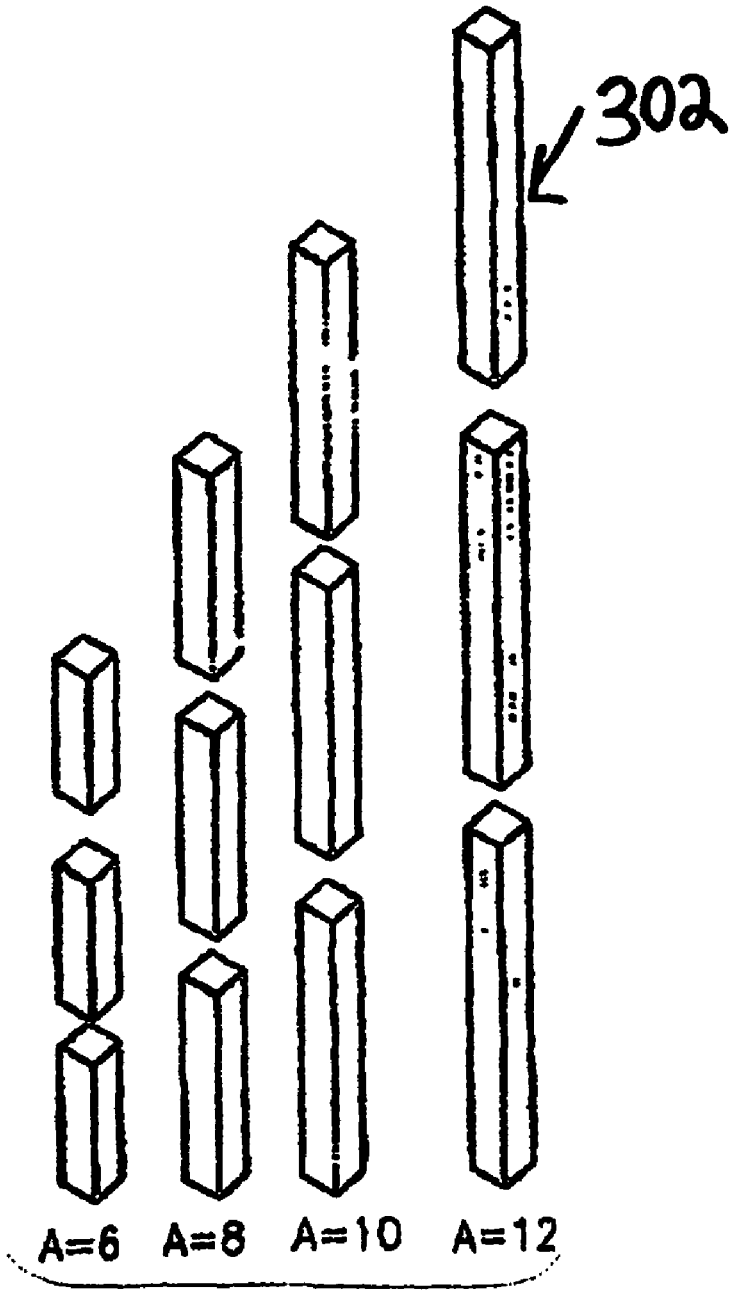
FIG. 1*b* is a perspective view of the width determining exchangeable installation tool segments used to accommodate the size of the barrier to be installed.

FIG. 1*a*, a perspective exploded view of area "FIG. 1*a*" as indicated in FIG. 1, illustrates the attachment means used for the temporary attachment of installation tool 355 to fire barrier 350. Installation tool 355 is positioned on barrier 350 by fitting apertures of fasteners 76T over ends of pins 72T that extend from the outer side of protective cloth 30 through first insulation blanket 40 with adhered metallic backing layer 41, first fire-resistant supporting mesh 50, second insulation blanket 42 with adhered metallic backing layer 43, second fire-resistant supporting mesh 52, and fire-resistant strapping 60. As illustrated in FIG. 1*a* spacer 74T is then placed over the end of pin 72T that now extends out from one surface of fastener 76T. To secure the attachment of installation tool 355 to barrier 350, friction fit washer 70T is positioned over spacer 74T. Once T-shaped fire barrier installation tool 355 is securely attached to barrier 350 and barrier 350 is positioned in a T-shaped building expansion joint as illustrated in FIG. 1, barrier 350 is ready to be permanently attached to building units 90.

Figure 2:
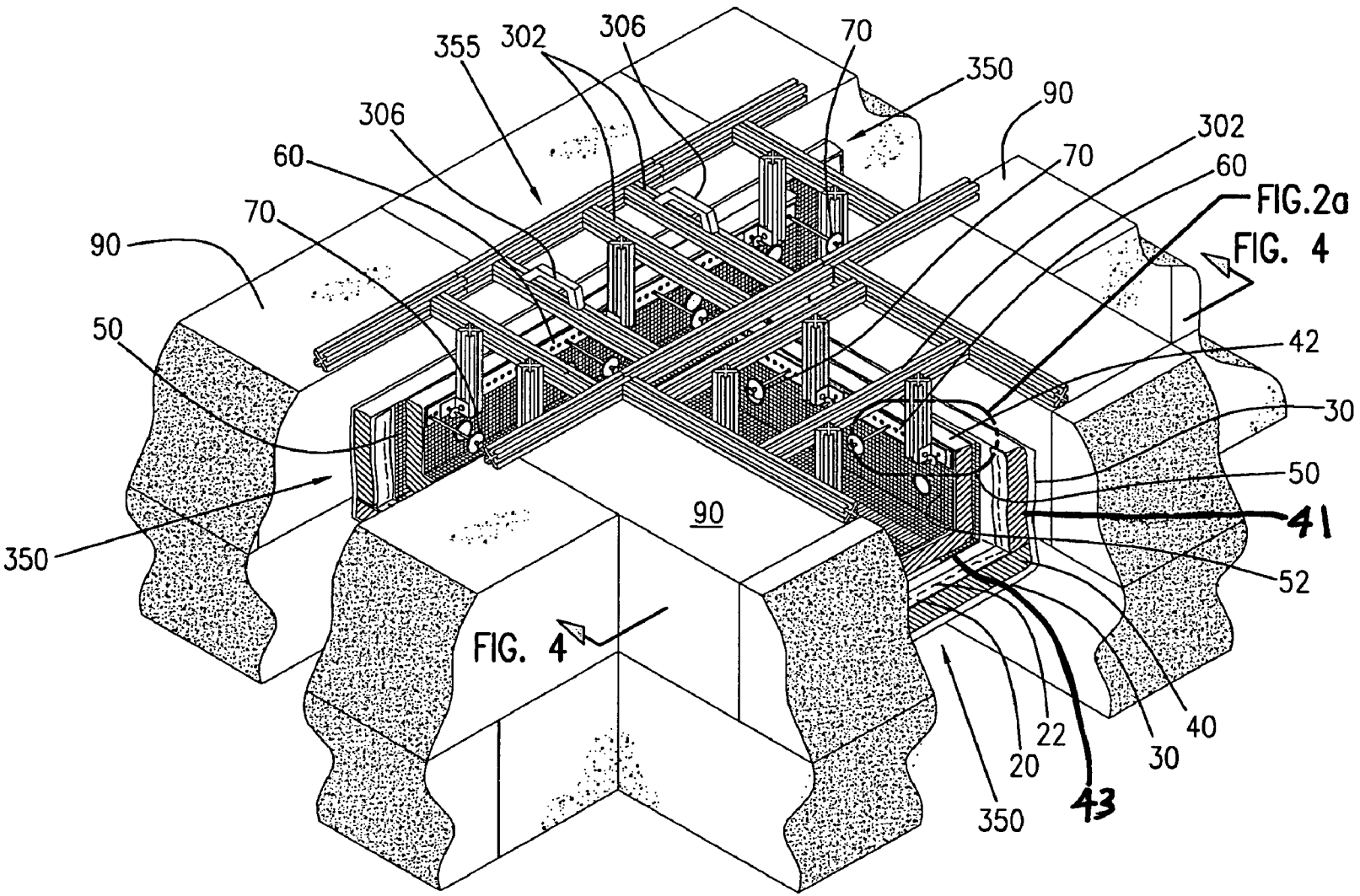
FIG. 2 is a perspective view illustrating the T-shaped barrier installation tool supporting the T-shaped fire barrier for inside-mounting the barrier in the T-shaped building expansion joint.

FIG. 2, a perspective view, illustrates T-shaped barrier installation tool 355 supporting T-shaped fire barrier 350 as T-shaped fire barrier 350 is being inside-mounted onto the building units 90 that form T-shaped building expansion joint. Fixedly attaching T-shaped fire barrier 350 to building units 90 is accomplished in this exemplary embodiment using attachment means 70, which means are better illustrated in FIG. 2*a*, a perspective exploded view of area "FIG. 2*a*" as indicated in FIG. 2. It is to be understood that the attachment means used to fixedly attach the barrier to the building units may be any known or yet to be known attachment means, such as bolts, screws, nails, staples, and adhesive to name a few.

Figure 2A:
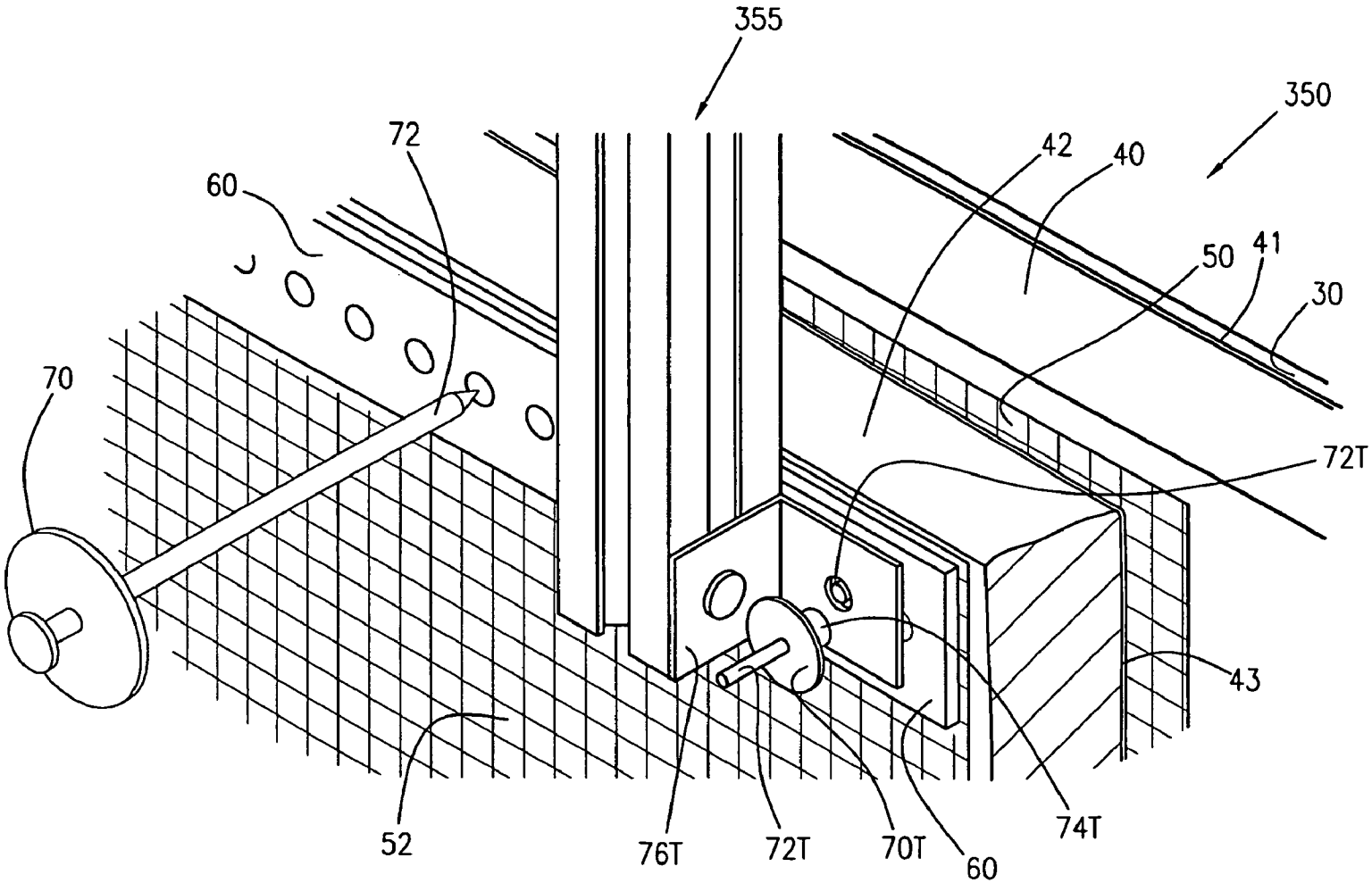
FIG. 2*a* is a perspective exploded view of area "FIG. 2*a*" as indicated in FIG. 2 to more clearly illustrate the attachment means used in the inside-mounted attachment of the T-shaped fire barrier to the T-shaped building units.

Pin 72 is illustrated in FIG. 2*a* being inserted into an aperture in strapping 60 to pass through second fire-resistant supporting mesh 52, second insulation blanket 42 with adhered metallic backing layer 43, first fire-resistant supporting mesh 50, first insulation blanket 40 with adhered metallic backing layer 41, protective cloth 30, and into the building unit 90 to fixedly attach fire barrier 350 to building unit 90. Washer 70 assures the secure fit of pin 72. Pin 72 illustrates one mounting means for mounting a fire barrier to a building structure. Where the building structure is concrete, the mounting means would have to be any mounting means adapted for mounting an object to a concrete structure, such as a Hilti Gun. Accordingly, if the building structure is of a material other than concrete, the mounting means would be adapted accordingly. Such mounting means are well known in the art and need not be discussed further here.

Also illustrated in FIG. 2*a* is the removal of friction fit washers 72T, spacers 74T, and pins 72T from installation tool 355 to prepare for the removal of the installation tool from the fire barrier so that the installation tool may be used to install the next fire barrier. Spacer 74T provides for easy removal of installation tool 355 from barrier 350 once the installation of barrier 350 into a three-way expansion joint is complete in that spacer 74T provides for friction fit washer 72T to be easily and rapidly removed from pin 72T using only a simple pair of pliers. Spacer 74T is then simply lifted from 72T using only finger effort. When all of the washers and spacers are removed from the installation tool the tool is removed ready for the next installation, and the pins are clipped close to the surface of the strapping.

Figure 3:
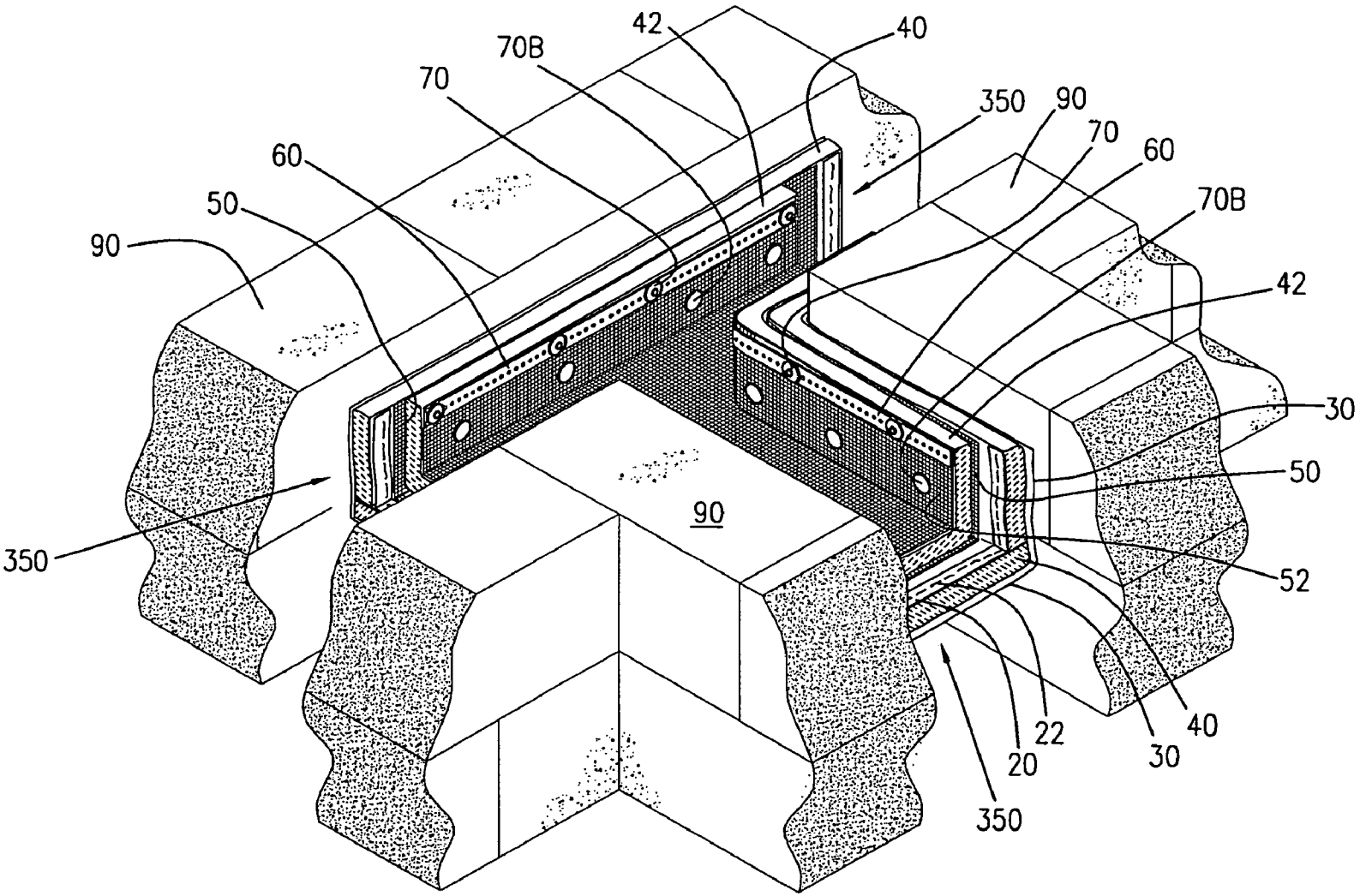
FIG. 3 is a perspective view illustrating the inside-mounted T-shaped fire barrier after the T-shaped barrier installation tool is detached.

FIG. 3, a perspective view, illustrates inside-mounted T-shaped fire barrier 350 fixedly attached to building units 90 after T-shaped barrier installation tool 355 is detached. The installation of T-shaped fire barrier 350 is now complete.

Figure 4:
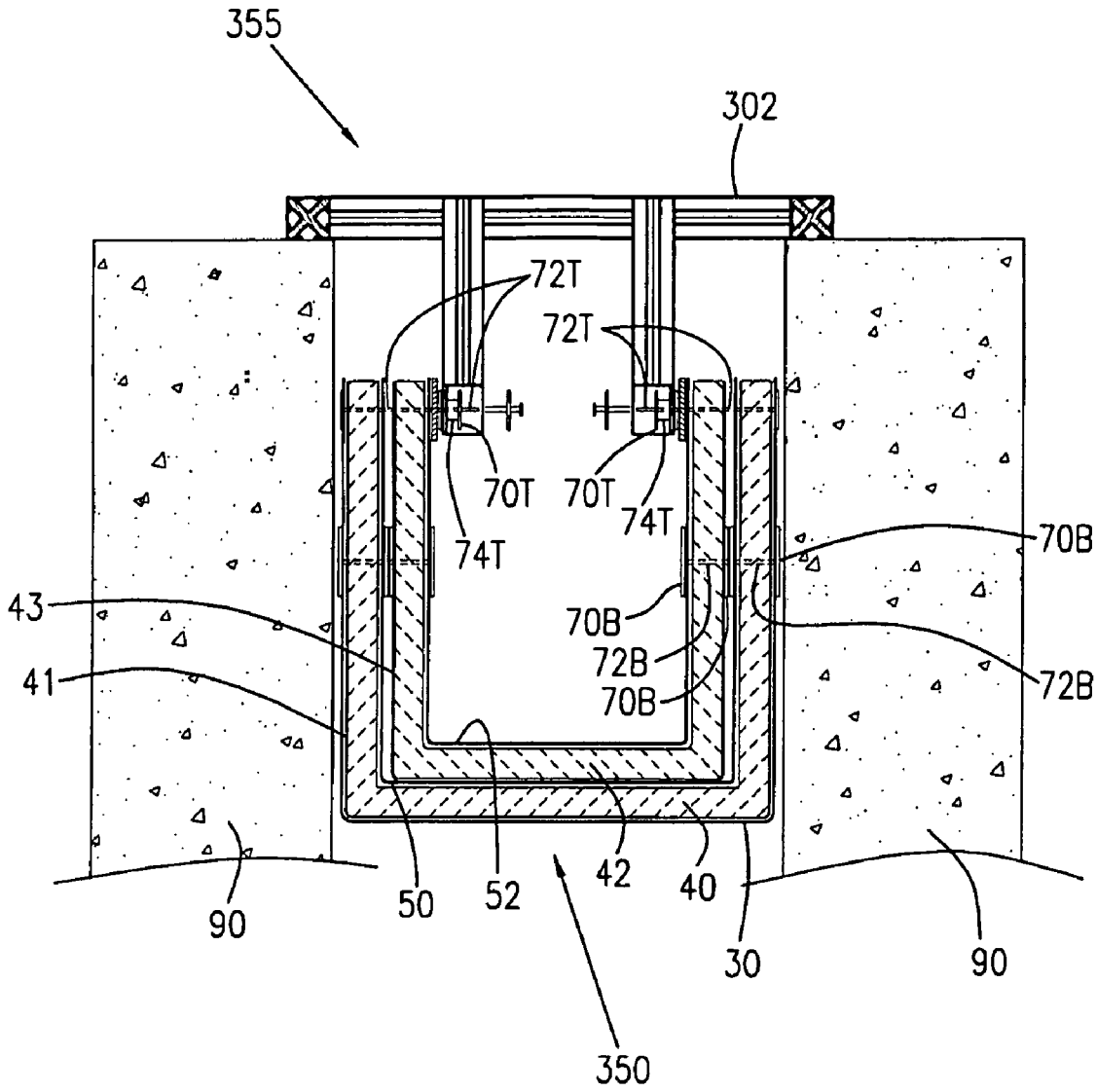
FIG. 4 is a cross-section view taken along line FIG. 4-FIG. 4 of FIG. 2 illustrating the inside-mount attachment of the T-shaped fire barrier to T-shaped building units before the T-shaped barrier installation tool is detached from the barrier.

FIG. 4, a cross-section view taken along line FIG. 4-FIG. 4, illustrating the inside-mount attachment of the T-shaped fire barrier to T-shaped building units before the T-shaped barrier installation tool is detached from the barrier. FIG. 4 illustrates one way that the various sheets of fire resistant materials may be attached to each in the early stages of the formation of the fire barrier. In this example, outer protective cloth 30 is attached to first insulation blanket 40 with adhered metallic backing layer 41 and edged with intumescent strip material 20 that is stitched to first insulation blanket 40 by means of high-temperature thread 22 and to first fire-resistant supporting mesh 50 using pins 72B and capping friction fit washers 70 on each end. Likewise, second insulation blanket 42 with adhered metallic backing layer 43 is attached to second fire-resistant supporting mesh 52 using pins 72B and capping friction fit washers 70 on each end.

It should be obvious that each of the styles of spreader disclosed is as suitable for fitting around a corner as it is for fitting along a straight line fire barrier segment.

Thus it has been shown that the present invention comprises fire and cycle tested pre-assembled, multi-directional fire barriers, constructed as single-piece units that require no spicing for installation purposes, are designed for inside-mount installation into multi-directional architectural expansion joints formed by the intersection of two or more architectural expansion joints to prevent the migration of heat, gases, flame, and smoke through the expansion joint spaces of structures, where each barrier is provided with a one-step, low cost, and a reusable installation tool for drop-in installation.

What is claimed is:

1. A fire barrier, comprising:

a fire barrier assembled as a unitary whole shaped for installation into an accepting expansion joint space or spaces, each of said joint spaces defined by adjacent spaced facing surfaces of a first and a second building unit, said fire barrier comprising:

a fire-resistant protective sheet fabricated from materials selected from the group consisting of silica filament yarns, polymeric material, fiber reinforced polymeric materials, high-temperature resistant woven textiles, or a metalized fiberglass or ceramic cloth, overlain by a gas and smoke impermeable metal or metalized sheet, and a high-temperature resistant fibrous insulation sheet, said plurality of sheets layered and formed into a U-shape barrier to be disposed within said joint space providing for one arm of said U-shaped barrier to be directly vertically fastenable to the facing surface of the first building unit and a second arm to be directly vertically fastenable to the facing surface of the second building unit and an intermediate portion having a width to be located generally within the joint space, and attachment devices for insertion first through a retainer strap and then through said layered sheets of one arm of the U-shaped barrier and into one of said surfaces, and attachment devices for insertion first through a retainer strap and then through said layered sheets of the other arm of the U-shaped barrier and into the other of said surfaces, so that when said attachment devices fasten said fire-barrier vertically and directly to opposing sides of the joint space an inside-mounted fire barrier is achieved.

2. The fire barrier, as recited in claim 1 further comprises:

a fire-resistant insulation blanket layer, an intumescent material layer, and, a fire-resistant protective cloth layer.

3. The fire barrier, as recited in claim 2, further comprising:

a mechanical support layer, said mechanical support layer, said intumescent layer, said insulation blanket layer, and said protective cloth layer being locally attached together by at least one of a attachment means selected from the group consisting of tape, tacks, rivets, stitches, staples, pins, nails, screws, and adhesives.

4. The fire barrier, as recited in claim 2, further comprising wherein said intumescent material further comprises being stitched to first insulation blanket by means of high-temperature thread.

5. The fire barrier as recited in claim 1, further comprising wherein said fire barrier is constructed as a T-shaped fire barrier for installation into the accepting intersection-space.

6. The fire barrier, as recited in claim 1, further comprising wherein said fire barrier when installed between the facing surfaces of the two building units adopts a U-shape form.

7. The fire barrier, as recited in claim 6, further comprising wherein an end of each vertical arm of said U-shaped fire provides an attachment area for the direct, vertical attachment of the barrier to the facing surfaces of the building units.

* * * * *

UNITED STATES PATENT AND TRADEMARK OFFICE

CERTIFICATE OF CORRECTION

PATENT NO. : 7,941,981 B2
APPLICATION NO. : 11/709947
DATED : May 17, 2011
INVENTOR(S) : Alan Shaw It is certified that error appears in the above-identified patent and that said Letters Patent is hereby corrected as shown below:

In the Claims

Column Number 12, line 16, the word "fire" as in "U-shaped fire" should read -- form -- as in "U-shaped form."

Signed and Sealed this
Thirtieth Day of September, 2014

Michelle K. Lee

Michelle K. Lee
*Deputy Director of the United States Patent and Trademark Office*